US010559232B1

(12) United States Patent
Keeler

(10) Patent No.: US 10,559,232 B1
(45) Date of Patent: Feb. 11, 2020

(54) ANTI-THEFT SIGN BRACKET AND SIGN ASSEMBLY AND METHOD

(71) Applicant: Utility Compliance Consultants, LLC, Exton, PA (US)

(72) Inventor: Paul Keeler, Exton, PA (US)

(73) Assignee: Utility Compliance Consultants, LLC, Exton, PA (US)

( * ) Notice: Subject to any disclaimer, the term of this patent is extended or adjusted under 35 U.S.C. 154(b) by 0 days.

(21) Appl. No.: 16/045,908

(22) Filed: Jul. 26, 2018

(51) Int. Cl.
*G09F 7/18* (2006.01)
*E04H 17/16* (2006.01)

(52) U.S. Cl.
CPC ..... *G09F 7/18* (2013.01); *E04H 17/16* (2013.01); *G09F 2007/1856* (2013.01)

(58) Field of Classification Search
CPC ..... G09F 2007/1856
USPC ..... 40/606.03, 665; 248/219.1, 219.3, 219.4, 248/228.8, 230.8
See application file for complete search history.

(56) References Cited

U.S. PATENT DOCUMENTS 5,277,390 A * 1/1994 Olson ..... F16L 3/11 248/218.4
5,556,080 A 9/1996 Vise
5,732,446 A 3/1998 Blanks
6,109,577 A * 8/2000 Dziedzic ..... G09F 7/18 248/230.8
6,769,207 B1 * 8/2004 Brown ..... G09F 7/18 40/607.12
7,594,631 B1 * 9/2009 Carnevali ..... B60R 11/0241 248/219.4
7,997,546 B1 * 8/2011 Andersen ..... F16B 2/08 248/214
2011/0271571 A1 * 11/2011 Lennard ..... G09F 7/18 40/606.01
2017/0096835 A1 4/2017 Messelis

FOREIGN PATENT DOCUMENTS

WO 92-00496 A1 1/1992

* cited by examiner

*Primary Examiner* — Joanne Silbermann
(74) *Attorney, Agent, or Firm* — Howson & Howson LLP

(57) ABSTRACT

A theft-resistant sign bracket for use with a ballistic fence comprises a bracket member having a slot for a one-way bolt used to secure a sign to the bracket, an internal space, elongated in the direction of elongation of the slot, for receiving and preventing rotation of a nut engaged with the shank of the bolt while allowing positioning of the nut and bolt at a desired location along the slot, and a metal tie strip extending through an internal passage in the bracket and capable of being passed through two spaced openings in the ballistic fence for securing the bracket to the fence. One or more grooves formed in the space through which the tie strip extends prevent lateral movement of the bracket relative to the tie strip.

12 Claims, 4 Drawing Sheets

ANTI-THEFT SIGN BRACKET AND SIGN ASSEMBLY AND METHOD

FIELD OF THE INVENTION

This invention relates generally to sign-supporting brackets, and more specifically to a theft-resistant sign assembly, incorporating a bracket, wherein a sign, including a banner or the like, is secured to a face of a ballistic fence, i.e., a fence capable of stopping or resisting penetration by projectiles.

BACKGROUND OF THE INVENTION

One known form of theft-resistant sign bracket is a bracket comprising an elongated element molded from a synthetic resin. A bolt extends through an elongated slot in the molded element and is engaged with a nut located in a nut-receiving space within the molded element, the nut-receiving space being elongated along the direction of elongation of the slot. The nut is slidable in the direction of elongation of the slot but restrained against rotation by opposed internal walls of the nut-receiving space. The bolt is a "one-way" bolt, having a receptacle formed in its head for receiving the tip of a screwdriver. The receptacle is formed with surfaces configured to allow clockwise rotation of the bolt by the screwdriver but to deflect the screwdriver axially outward from the receptacle when the screwdriver is rotated counterclockwise. End slots, formed in opposed ends of the elongated molded element, are engageable with lengths of fence wire on opposite sides of an opening of a chain link fence and a wall of at least one of the end slots is provided with a hole for a screw or similar fastener used to maintain engagement of that end slot with the length of fence wire extending through it.

In a typical sign installation, four such brackets are attached to the chain link fence in positions such that the bolt of each bracket can be aligned with one of the holes in a sign to be attached to the fence. The elongation of the slot, and the movability of the bolt in the direction of elongation of the slot and the elongated nut-receiving space, allow the bracket to be adjusted to accommodate variations in the positions of the bolt holes in the sign.

The brackets and the bolt holes in the sign are typically located inboard relative to the edges of the sign to make access to the brackets difficult after the bolts are tightened. Thus the sign can be secured to a chain link fence in such a way that a thief not equipped with special tools will encounter a considerable amount of difficulty in attempting to remove the sign.

The bracket described above is suitable for use with chain link fences. However, in recent years, so-called, "high security" or "ballistic" fences have come into widespread use to protect equipment such as electric substation transformers and the like by preventing damage to the equipment by bullets and other projectiles.

A typical ballistic fence includes a unitary layer of heavy-gauge steel formed with an array of horizontally elongated undulating strips extending parallel to one another. The undulations of adjacent strips are offset from one another so that parallel columns of narrow, horizontally elongated, slots are formed in the heavy-gauge steel layer.

The unitary layer of steel formed with undulating strips and horizontally elongated slots is typically welded to, and reinforced by, a mesh of horizontally- and vertically-extending, heavy-gauge steel wires. The unitary layer of steel forms an outer face of the fence, and the mesh of steel wires forms an inner face of the fence.

The bracket described above, which is designed for use with chain link fences, cannot be fitted to a ballistic fence in a manner similar to the manner in which it is fitted to a chain link fence. That is, the end slots in the elongated molded element cannot be readily engaged with the undulations of the ballistic fence.

There has been a need for a sign bracket having a capability of bolt-position adjustment similar to that of the sign bracket designed for chain link fencing, and also having the capability of secure attachment to a ballistic fence.

SUMMARY OF THE INVENTION

In the bracket assembly of this invention, the bracket can be a modified version of the bracket previously utilized for securing a sign to a chain link fence. The principal modification is the addition of a tie strip and the adaptation of the bracket so that it has an internal passage for receiving the tie strip.

More specifically, the bracket comprises a rigid element having a first outer surface facing in a first direction for abutment with a fence, and a second outer surface facing in a second direction opposite the first direction. An internal, nut-receiving, space is provided within the rigid element, and a bolt shank-receiving opening, formed in the second outer surface, leads from the second outer surface to the internal, nut-receiving, space. A bolt for attachment of a sign to the rigid element, has a threaded shank extending through the bolt shank-receiving opening, and a nut located in the internal, nut-receiving, space is threaded to the shank of the bolt. The bolt includes a head external to the rigid element.

An internal passage is provided within the rigid element, and a flexible metallic tie strip extends through this internal passage. The tie strip has a locking head at one end thereof engageable with a part of the strip remote from the locking head whereby the tie strip can form a loop. The locking head permits reduction of the size of the loop but prevents the size of the loop from increasing.

In the completed sign assembly, the loop extends through the internal passage in the rigid element and through two of a plurality of openings extending through the fence, and is tightened by reduction of the size of the loop whereby the rigid element is firmly fixed to the fence. The shank of the bolt extends through at least one through hole of a sign, and is in tightened engagement with the nut so that the sign is firmly attached to the rigid element of the bracket.

In a preferred embodiment, the bolt shank-receiving opening and the internal, nut-receiving, space in the rigid element are elongated along the same direction.

The rigid element is preferably composed of molded synthetic resin, and at least a part of the internal passage for receiving the tie strip may be constituted by the internal, nut-receiving, space.

The internal passage for receiving the tie strip can also include a groove receiving the tie strip and having a width substantially equal to the width of the tie strip whereby the groove restricts lateral movement of the bracket relative to the tie strip.

The bracket assembly of the invention is especially well adapted for use in attaching a sign to a ballistic fence in which each opening of the plurality of openings is in the form of a slot elongated in a first direction on an outer face of the fence, and the openings are arranged in parallel columns extending in a second direction along the face and substantially perpendicular to the first direction. The first outer surface of the rigid element can overlie a part of one of the parallel columns of slots so that the rigid element overlies a plurality of slots in one of said parallel columns. An example of such a ballistic fence is one that comprises a unitary array of undulating strips extending in first direction in parallel rows along an outer face, and in which the undulations of adjacent strips are offset from one another in that first direction so that parallel columns of openings are formed in the fence.

Another aspect of the invention is the process by which a sign is fastened to a fence using the bracket and tie strip. The process is applicable for the attachment of a sign to any fence that comprises a panel having an inner face and an outer face and having a plurality of openings extending through the fence from the outer face to the inner face, wherein each opening of said plurality of openings is in the form of a slot elongated in a first direction on the outer face of the fence, and the openings are arranged in parallel columns extending in a second direction along substantially perpendicular to the first direction. In carrying out the process, the tie strip is passed through an interior passage in the bracket. The tie strip is preferably a flexible metallic tie strip having a locking head at one end thereof engageable with a part of the strip remote from the locking head so the strip can form a loop. The locking head permits reduction of the size of the loop but prevents the size of the loop from increasing. The tie strip is inserted through the interior passage of the bracket so that a first portion of the tie strip between the locking head to the remote part of the strip is disposed within the interior passage of the bracket, and the locking head and the remote part are connected respectively to the first portion of the tie strip by second and third portions thereof that protrude respectively from opposite ends of the interior passage of the bracket. The bracket is placed against the outer face of the fence, and the second and third portions of the tie strip are inserted through different slots in one of the columns of slots. The locking head is then engaged with the remote part of the tie strip to form the tie strip into a loop. Then the loop is caused to contract so that the bracket is secured to the fence. A threaded bolt is inserted through a hole in the sign and into a bolt-shank receiving opening in the bracket, and engaged with a nut inside the bracket.

The sign can be loosely bolted to a bracket either before or after the bracket is secured to the fence. If the sign is loosely bolted to each of a plurality of sign-supporting brackets before the brackets are secured to the fence, the tie strips can be inserted through slots in the fence and their locking heads engaged with their remote portions. The bolts and tie strips can then be tightened in any desired order. By bolting the sign to the brackets before attachment of the brackets to the fence, difficulties in aligning the bolts with the nuts inside the brackets can be avoided.

DETAILED DESCRIPTION OF THE PREFERRED EMBODIMENTS

Figure 1:
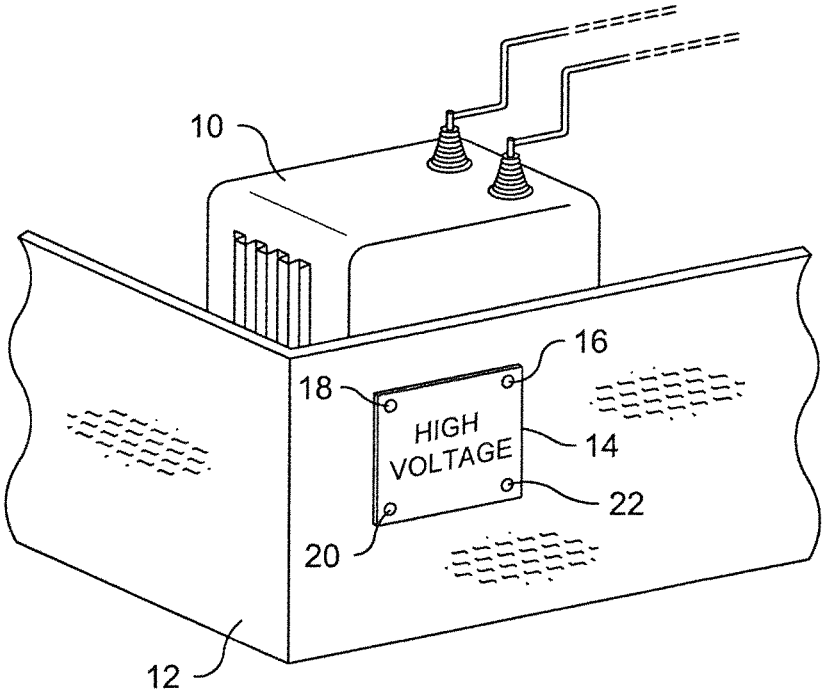
FIG. 1 is a perspective view showing a part of an electrical utility installation protected by a ballistic fence bearing a sign attached by set of bracket assemblies according to the invention.

In the electrical utility installation illustrated in FIG. 1, a utility transformer 10 is protected by a ballistic fence 12. A sign 14, for example a warning sign, which is typically, although not necessarily, in the form of a rectangular panel, is attached to the ballistic fence. Four bolts, 16, 18, 20 and 22, located adjacent the respective corners of the sign, extend though the panel and are affixed to the ballistic fence by bracket assemblies (not shown in FIG. 1) which will be described with reference to FIGS. 2-8.

Figure 2:
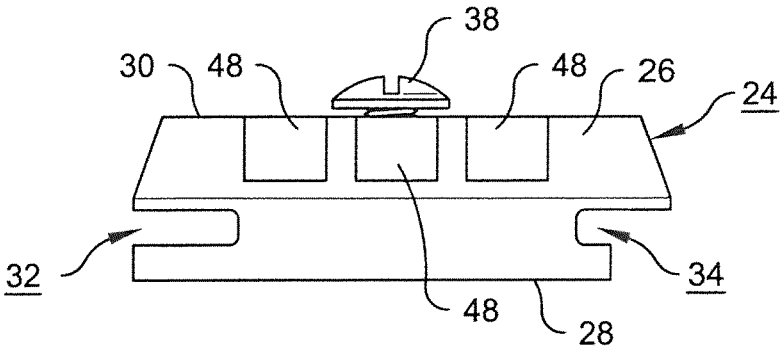
FIG. 2 is a side elevational view of an elongated, molded, bracket member according to the invention.

The bracket member 24, as shown in FIG. 2, comprises a rigid element 26, preferably molded from a suitable synthetic resin such as a polyamide resin, an acetal polymer, or an acrylonitrile-butadiene-styrene polymer. The rigid element 26 is formed with a first outer surface 28 for abutting engagement with an outer face of the ballistic fence 12 shown in FIG. 1. Rigid element 26 is formed with a second, outer surface 30 for abutting engagement with a back surface of a sign panel. Surface 28 faces in a first direction and surface 30 faces in a second direction opposite to the first direction. The fence engaging surface 28 is preferably planar, and the sign panel-abutting surface 30 is also preferably planar.

The bracket shown in FIG. 2 is elongated and can be formed with slots 32 and 34 that can receive wires on the opposite sides of an opening of a conventional chain-link fence, so that the bracket can be optionally used to secure a sign to a chain-link fence. However, the slots 32 and 34 are unnecessary when the bracket is to be used only with a ballistic fence.

Figure 3:
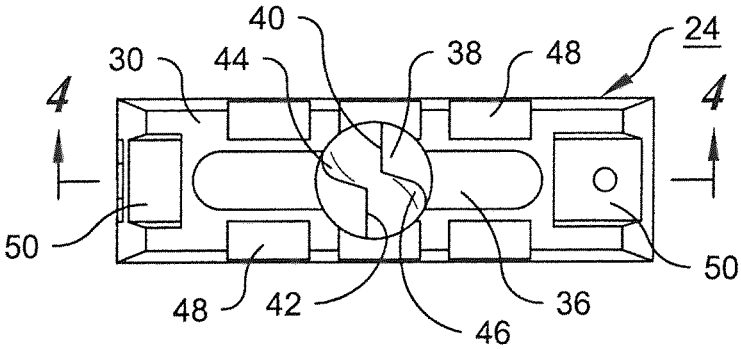
FIG. 3 is a front elevational view of the bracket member of FIG. 2.

As shown in FIGS. 2 and 3, the bracket member 24 can is formed with an elongated opening in the form of a slot 36, surrounded by the sign panel-abutting surface 30. This slot 36 receives the shank of a "one-way" bolt 38, preferably formed of stainless steel. As shown in FIG. 3, the head of the bolt is configured with surfaces 40 and 42, which disposed on spaced imaginary planes parallel to the bolt axis. These surfaces are offset from each other and capable of being engaged by a screwdriver or other driving tool for clockwise rotation of the bolt. The head of the bolt, however is formed with surfaces 44 and 46, which are oblique relative to the bolt axis and configured to exert a camming action on the blade of a screwdriver to prevent the screwdriver from being used to rotate the bolt counterclockwise.

Indentations 48 and 50, formed in the bracket member 24, are optional, and provided primarily to reduce the weight of the bracket and avoid excessive and unnecessary synthetic resin.

Figure 4:
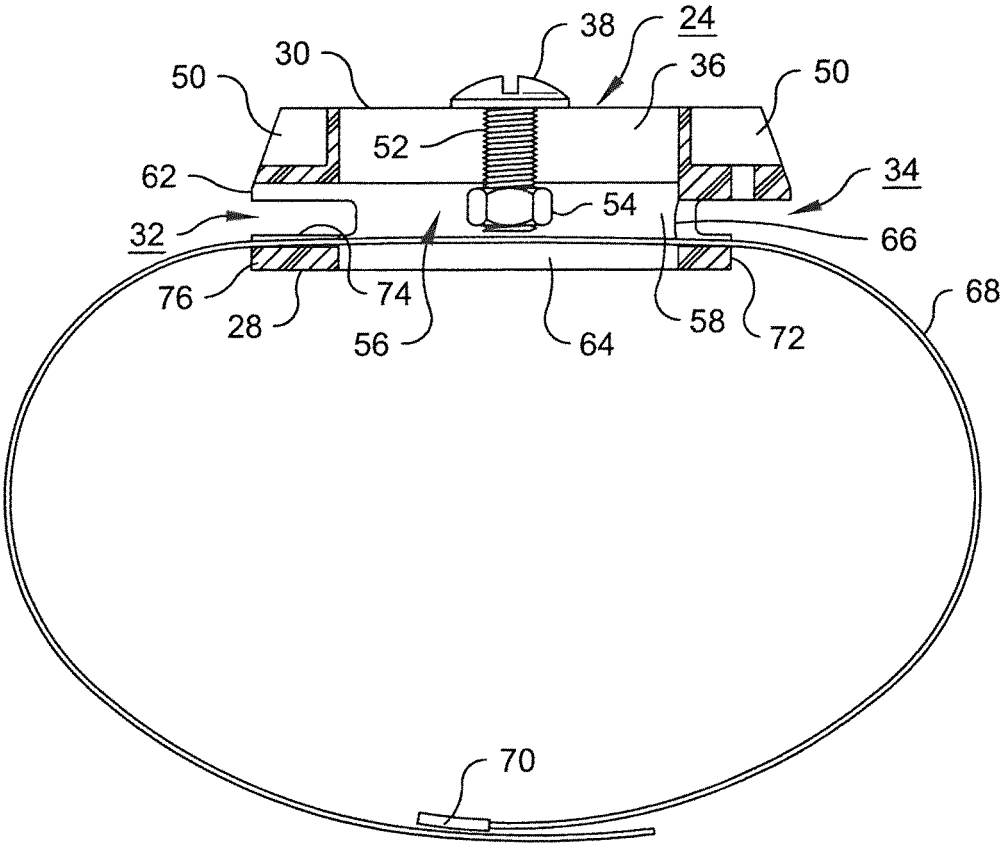
FIG. 4 is a cross-sectional view of taken on section plane 4-4 in FIG. 3, and showing the relationship between the bracket member and a tie strip used to secure the bracket member to the ballistic fence.

As shown in FIG. 4, the shank 52 of bolt 38 extends through slot 38, and is engaged with a stainless steel nut 54, disposed in an internal nut-receiving space 56. Space 56 is elongated in the direction of elongation of the slot 36, and defined by parallel walls 58 and 60, wall 58 being shown in FIG. 4 and both walls being shown in FIG. 5. The nut 54 is hexagonal, but any nut configuration, preferably one having parallel opposite surfaces, e.g., a square nut or an octagonal nut, can be utilized. The size of the nut should be such that the spacing of its opposite parallel surfaces is slightly less than the spacing between parallel walls 58 and 60 in internal space 56.

The nut 54 can be inserted into space 56 through an opening 62, shown in FIG. 4. Optionally, this opening can be of a width slightly less than the distance between opposite faces of the nut in order to achieve an interference fit. Although the bracket member is essentially rigid, a small amount of resilience of the resin forming the bracket member can allow the nut to be inserted into space 56 through opening 62, and the bracket member 24 can then be supplied with the nut 54 in place in space 56 and ready for engagement by the shank of bolt 38. As shown in FIG. 4, an elongated slot 64, parallel to slot 36 may be provided in the wall of space 56 adjacent surface 28 for accommodating a portion of the shank of the bolt if the length of the shank is such that it will extend past that wall of space 56 when the bolt is tightened.

Figure 6:
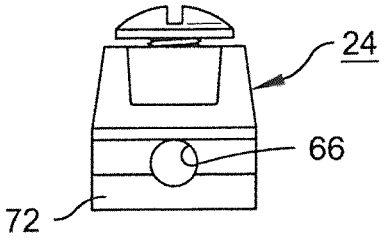
FIG. 6 an elevational view of the right end of the elongated bracket member as shown in FIG. 4.

As shown in FIGS. 4 and 6, an opening 66 is provided at the end of space 56 opposite from opening 62 for receiving a flexible metallic tie strip 68. The tie strip is preferably a stainless steel strip having a polyester coating and having a locking head 70 at one end, the head being engageable with a remote part of the strip so that the strip can be formed into a loop and the locking head can allow reduction of the size of the loop but prevent the size of the loop from increasing.

A suitable flexible metallic tie strip is one in which the locking head incorporates a movable ball or roller and a cam surface that urges the ball or roller tightly against a part of the strip extending through the locking head when the strip is pulled in a direction to enlarge the loop. Such a metallic tie strip is described in U.S. Pat. No. 5,732,446, granted on Mar. 1, 1998. The entire disclosure of U.S. Pat. No. 5,732,446 is here incorporated by reference. Other forms of tie strips, such as tie strips having ratchet teeth and a resilient pawl can also be used.

Figure 5:
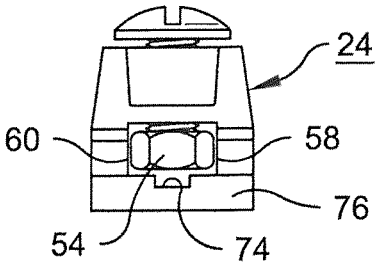
FIG. 5 is an elevational view of the left end of the elongated bracket member as shown in FIG. 4.

As shown in FIG. 4, the tie strip 68 extends through opening 66, space 56, and opening 62. Opening 66 is preferably positioned as shown in FIG. 5 so that a part of the opening forms a recess in the flange 72 that forms a boundary of slot 34. This recess receives the tie strip when the strip is tightened and resists relative movement of one end of the bracket member relative to the tie strip when the tie strip is engaged with a fence and tightened. A groove 74 in the flange 76, which forms a boundary of slot 32 as shown in FIGS. 4 and 5, serves a purpose similar to that of the recess in flange 72, resisting relative movement of the opposite end of the bracket member relative to the tie strip. Together, the recess formed in flange 72 by a part of opening 66 and groove 74 secure the bracket against lateral movement relative to the tie strip in directions along the face of the fence to which the bracket is attached. The opening 66 and space 56, along with a portion of the interior of the bracket member extending from opening 32 toward space 56, form an internal passage in the bracket member through which the tie strip extends. Thus, at least a part of the internal passage that receives the tie strip is constituted by the internal nut-receiving space 56, and the internal passage for receiving the tie strip includes a groove receiving the tie strip, the groove being constituted in part by groove 74 at one end of the tie strip-receiving passage, and in part by a portion of opening 66 at the opposite end of the tie strip-receiving passage.

Figure 7:
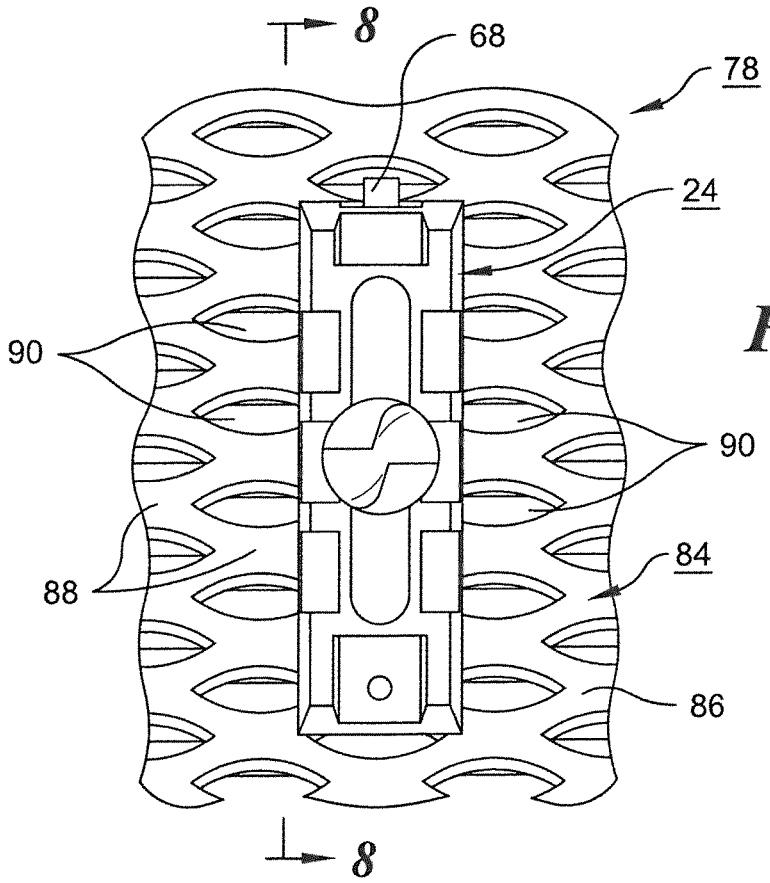
FIG. 7 is a fragmentary elevational view showing a portion of a ballistic fence, and showing the bracket member secured to a face of the ballistic fence.
Figure 8:
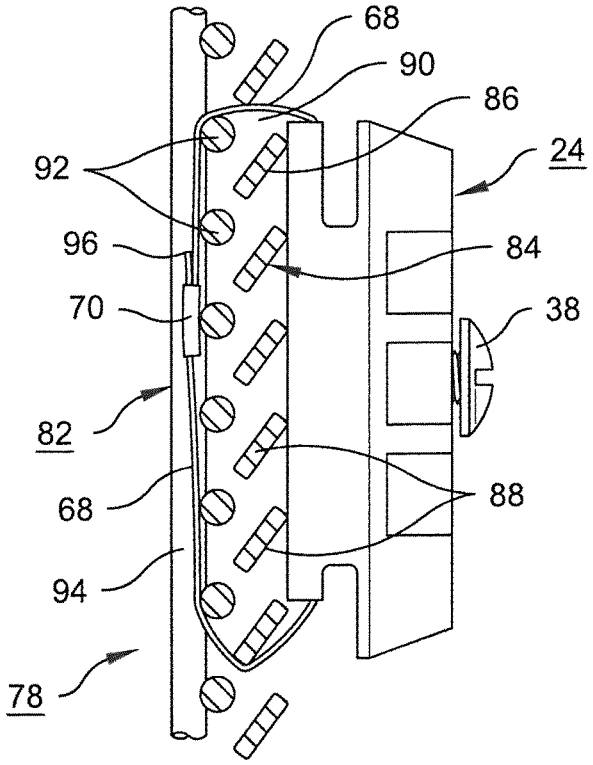
FIG. 8 is a cross-sectional view taken on section plane 8-8 in FIG. 7.

FIGS. 7 and 8 show the bracket member 24 secured to a ballistic fence 78 by the tie strip 68. The ballistic fence essentially comprises a panel having an inner face 82 and an outer face 84 and having a plurality of openings extending through the fence from the outer face to the inner face. In the particular embodiment shown, the fence is composed of a unitary layer 86 of heavy-gauge steel formed with an array of horizontally elongated undulating strips 88 extending parallel to one another. The undulations of adjacent strips are offset from one another so that parallel columns of narrow, horizontally elongated, slots 90 are formed in the heavy-gauge steel layer.

In the embodiment illustrated in FIGS. 7 and 8, the unitary layer of steel formed with undulating strips and horizontally elongated slots is welded to, and reinforced by, a mesh composed of horizontally extending heavy-gauge steel wires 92 and vertically-extending, heavy-gauge steel wires 94. The unitary layer of steel forms an outer face of the fence, and the mesh of steel wires forms an inner face of the fence.

As shown in FIG. 8, the bracket member 24 is secured to the fence by passing the tie strip 68 through the internal passage in the bracket member formed by hole 66 and space 56, bringing the first outer surface 28 of the bracket into abutting engagement with the outer face of the ballistic while passing the end portions of the tie strip 68 respectively through two different openings 90 in the fence. These openings will ordinarily be two openings in the same column of openings, and may be spaced from each other by one or more intermediate openings in the column. In the embodiment illustrated in FIGS. 7 and 8, the strip is also passed through spaces between horizontal wires 92. The end of the tie strip remote from the locking head 70 is then passed through the locking head and pulled relative to the locking head until the loop formed by the tie strip tightens and secures the bracket member to the fence. A portion of the tie strip extending beyond the locking head may be cut off at location 96.

The sign 14 (FIG. 1) may be secured to the bracket by bolt 38 either before or after the bracket is attached to the fence. Therefore, in a typical installation, one or more of the brackets may be first loosely fastened to a sign by one-way bolts. Then the brackets may be secured to the fence, moving them longitudinally relative to the bolts if necessary to position the tie strips so that they can be passed through the openings in the fence. Afterwards, the bolts and tie strips can be tightened. These steps can be carried out in different orders. For example, as an alternative, the brackets can be first loosely secured to the fence by the tie strips and the sign can be thereafter connected to the brackets by bolts, and the bolts and tie strips can then be tightened.

The invention is applicable to various forms of fences other than the particular form of ballistic fence described above and depicted in FIGS. 7 and 8. For example the sign brackets of the invention can be utilized to secure signs to fences of the kinds described in U.S. Pat. No. 5,556,080, granted on Sep. 17, 1996, United States Patent Publication No. 2017/0096835, published on Apr. 6, 2017, or International Patent Publication No. WO 92/00496, published on Jan. 9, 1992.

Figure 9:
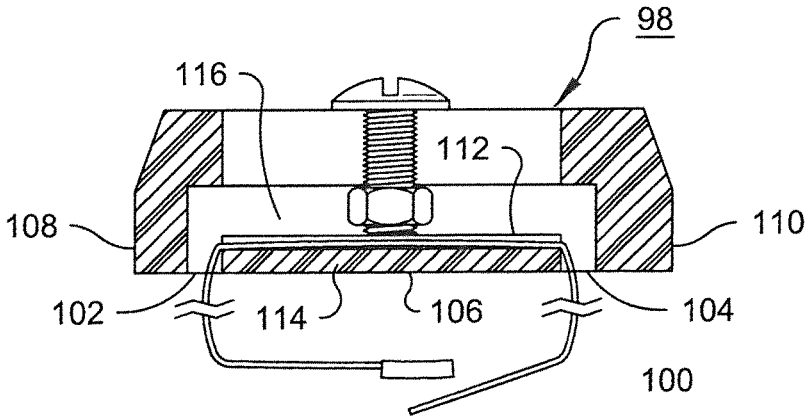
FIG. 9 is a cross-sectional view showing a modified embodiment of the bracket assembly.

The use of one-way bolts, the configuration of the face of the ballistic fence, the proximity of the sign to the face of the fence, and inboard locations of the brackets relative to the edges of the sign will ordinarily be effective to prevent tampering, for example by attempting to cut portions of the tie strip exposed on the outer side of the fence. However, in cases where such tampering is a matter of concern and alternative embodiment can be used in which there is no exposure of the tie strip on the outer side of the fence. For example, the bracket member 98 as shown in FIG. 9, is similar to bracket member 24 except that the tie strip 100 extends through openings 102 and 104 in the fence-engaging surface 106 of the bracket member. Parts 108 and 110 on opposite ends of the bracket member prevent access to the tie strip by a cutting tool inserted into a space between the sign and a fence. In this embodiment, the tie strip extends through a groove 112 formed on the interior side of a wall 114 between the fence-engaging surface and a nut-receiving space 116.

Other modifications can of course be made to the invention described herein without departure from the scope of the invention as defined in the following claims.

What is claimed is:

1. An anti-theft bracket assembly for attachment of a sign to a ballistic fence, said assembly comprising a bracket and a tie strip, wherein:

said bracket comprises a rigid element having a first outer, fence abutment, surface facing in a first direction a second outer surface facing in a second direction opposite said first direction, an internal, nut-receiving, space within said rigid element, a bolt shank-receiving opening formed in said second outer surface and leading from said second outer surface to said internal, nut-receiving, space, a bolt for attachment of a sign to said rigid element, said bolt having a threaded shank extending through said bolt shank-receiving opening, a nut located in said internal, nut-receiving, space and threaded to said shank, a head external to said rigid element, and an internal passage within said rigid element for receiving a tie strip; and said tie strip is a flexible metallic tie strip having a locking head at one end thereof engageable with a part of the strip remote from the locking head whereby the tie strip can form a loop, said locking head permitting reduction of the size of the loop but preventing the size of the loop from increasing, said tie strip extending through said internal passage in said rigid element, wherein said bolt shank-receiving opening and said internal, nut-receiving, space in said rigid element are elongated along the same direction.

2. The anti-theft bracket assembly according to claim 1, wherein at least a part of said internal passage for receiving said tie strip is constituted by said internal, nut-receiving, space.

3. An anti-theft sign assembly wherein a sign is attached to a ballistic fence, said assembly comprising a fence, a bracket, a tie strip, and a sign, wherein:

said fence comprises a panel having an inner face and an outer face and having a plurality of openings extending through the fence from the outer face to the inner face;

said bracket comprises a rigid element having a first outer surface facing and abutting said outer face of the fence and overlying a plurality of said openings, a second outer surface facing away from said outer face of the fence, an internal, nut-receiving, space within said rigid element, a bolt shank-receiving opening formed in said second outer surface and leading from said second outer surface to said internal space, a bolt for attachment of said sign to said rigid element, said bolt having a threaded shank extending through said bolt shank-receiving opening, a nut located in said internal, nut-receiving, space and threaded to said shank, a head external to said rigid element, and an internal passage within said rigid element for receiving said tie strip;

said tie strip is a flexible metallic tie strip having a locking head at one end thereof engageable with a part of the strip remote from the locking head whereby the strip forms a loop, said locking head permitting reduction of the size of the loop but preventing the size of the loop from increasing, said locking head being engaged with a part of the strip tie strip to form a loop, said loop extending through said internal passage in said rigid element and through two of said openings of said plurality of openings extending through the fence, and being tightened by reduction of the size of the loop whereby the rigid element is firmly fixed to said fence; and said sign is in the form of a panel having at least one through hole, said shank of the bolt extends through said at least one through hole of the sign and is in tightened engagement with said nut, whereby said sign is firmly attached to said rigid element of the bracket.

4. The anti-theft sign assembly according to claim 3, wherein each opening of said plurality of openings is in the form of a slot elongated in a first direction on said outer face of the fence, said openings being arranged in parallel columns extending in a second direction along said face and substantially perpendicular to said first direction, and wherein said first outer surface of said rigid element overlies a part of one of said parallel columns of slots whereby said rigid element overlies a plurality of slots in said one of said parallel columns.

5. The anti-theft sign assembly according to claim 3, wherein each opening of said plurality of openings is in the form of a slot elongated in a first direction on said outer face of the fence, said openings being arranged in parallel columns extending in a second direction along said face and substantially perpendicular to said first direction, wherein said first outer surface of said rigid element overlies a part of one of said parallel columns of slots whereby said rigid element overlies a plurality of slots in said one of said parallel columns, and wherein said fence comprises a unitary array of undulating strips extending in said first direction in parallel rows along said outer face, the undulations of adjacent strips being offset from one another in said first direction whereby said parallel columns of openings are formed in said fence.

6. The anti-theft sign assembly according to claim 3, wherein said bolt shank-receiving opening and said internal, nut-receiving, space in said rigid element are elongated along the same direction.

7. The anti-theft sign assembly according to claim 3, wherein each opening of said plurality of openings is in the form of a slot elongated in a first direction on said outer face of the fence, said openings being arranged in parallel columns extending in a second direction along said face and substantially perpendicular to said first direction, and wherein said first outer surface of said rigid element overlies a part of one of said parallel columns of slots whereby said rigid element overlies a plurality of slots in said one of said parallel columns, and wherein said bolt shank-receiving opening and said internal space in said rigid element are elongated along said second direction.

8. The anti-theft sign assembly according to claim 3, wherein the rigid element is composed of molded synthetic resin.

9. The anti-theft sign assembly according to claim 3, wherein at least a part of said internal passage for receiving said tie strip is constituted by said internal, nut-receiving, space.

10. The anti-theft sign assembly according to claim 3, wherein said bolt shank-receiving opening and said internal, nut-receiving, space in said rigid element are elongated along the same direction, and at least a part of said internal passage for receiving said tie strip is constituted by said internal, nut-receiving, space.

11. The anti-theft sign assembly according to claim 3, wherein at least part of said internal passage for receiving said tie strip is constituted by said internal, nut-receiving, space and said internal passage for receiving said tie strip includes a groove receiving said tie strip and having a width substantially equal to the width of the tie strip whereby said groove restricts lateral movement of the bracket relative to the tie strip.

12. A process for fastening a sign to a fence, said fence comprising a panel having an inner face and an outer face and having a plurality of openings extending through the fence from the outer face to the inner face, wherein each opening of said plurality of openings is in the form of a slot elongated in a first direction on said outer face of the fence, said openings being arranged in parallel columns extending in a second direction along said face and substantially perpendicular to said first direction, the process comprising the steps of:

inserting through an interior passage in said bracket, a flexible metallic tie strip having a locking head at one end thereof engageable with a part of the strip remote from the locking head whereby the strip can form a loop, said locking head permitting reduction of the size of the loop but preventing the size of the loop from increasing, said strip being inserted through the interior passage so that a first portion of said tie strip between the locking head to said remote part is disposed within said interior passage and said locking head and said remote part are connected respectively to said first portion of the tie strip by second and third portions thereof protruding respectively from opposite ends of said interior passage;

placing said bracket against said outer face of said fence;

inserting said second and third portions of said tie strip through different slots in one of said columns;

engaging said locking head with said remote part of the tie strip to form the tie strip into a loop, and causing said loop to contract thereby securing the bracket to the fence; and inserting a threaded bolt through a hole in said sign into a bolt-shank receiving opening in the bracket, and engaging said bolt with a nut inside the bracket.

* * * * *